US006199421B1

(12) United States Patent
Ploeger

(10) Patent No.: US 6,199,421 B1
(45) Date of Patent: Mar. 13, 2001

(54) DOUBLE FLARE GAUGE AND FORMING TOOL FOR TUBING

(75) Inventor: Randall J. Ploeger, Clarinda, IA (US)

(73) Assignee: Lisle Corporation, Clarinda, IA (US)

( * ) Notice: Subject to any disclaimer, the term of this patent is extended or adjusted under 35 U.S.C. 154(b) by 0 days.

(21) Appl. No.: 09/419,037

(22) Filed: Oct. 15, 1999

(51) Int. Cl.[7] ..... B21D 19/10
(52) U.S. Cl. ..... 72/317; 72/370.03; 72/370.1
(58) Field of Search ..... 72/317, 318, 461, 72/370.11, 370.1, 370.03, 370.01, 116

(56) References Cited

U.S. PATENT DOCUMENTS 3,421,354 * 1/1969 Strybel ..... 72/317
3,826,119 * 7/1974 Marotto ..... 72/461
4,535,616 * 8/1985 Eason ..... 72/317
6,062,060 * 5/2000 Nguyen ..... 72/317

OTHER PUBLICATIONS

Lisle Corporation Catalog T–57, Copyright 1997, p. 46, No. 31310, Double Flaring Tool Set.

* cited by examiner

*Primary Examiner*—Daniel C. Crane
(74) *Attorney, Agent, or Firm*—Banner & Witcoff, Ltd.

(57) ABSTRACT

A tool kit for forming a double flare on the end of deformable tubing includes a jig or bar assembly for holding the tubing, a combination gauge and tube forming anvil or adapter and a cone and yoke assembly. The gauge and tube forming anvil includes a lateral flange which is used to set the amount of extension of tubing from the bar assembly prior to deformation of the tubing by the adapter or anvil.

1 Claim, 4 Drawing Sheets

DOUBLE FLARE GAUGE AND FORMING TOOL FOR TUBING

BACKGROUND OF THE INVENTION

In a principal aspect, the present invention relates to tool set for forming the end of metallic tubing, and more particularly, to a tool set for forming a double flare on the end of deformable tubing, particularly metal tubing.

Vehicle brace lines, transmission lines, fuel lines and the like, typically use metal tubing with one or both ends formed with a double flare bend and a formed seat. That is, such tubing is generally metal tubing, and the open end is typically deformed to flare outwardly and then inwardly with a seat defined at the outer end surface of the tubing on the inwardly deformed portion. The double flare and seat is desired in order to effect a seal between the tubing and a fitting and to enhance the retention of the tubing by the fitting.

Various tool sets are available for flaring thin wall tubing of steel, aluminum or copper. The tool set typically includes a bar or jig assembly which holds the tubing in a fixed position with the end of the tubing projecting a fixed distance outwardly from the jig or holding bar. An adapter or anvil is provided for each size of tubing to deform the end of the tubing into a double flare form. A yoke assembly is provided for driving the anvil or adapter against the end of tubing to effect desired deformation and for finishing the seating surface at the end of the tubing. FIGS. 1, 2 and 3 of the present application illustrate a prior art double flare tool set of the type referenced.

The adapters or anvils used in the prior art tool sets are generally comprised of a series of cylindrical sections having a common axis with a cylindrical stud projecting from one end and a detent surface at the opposite end. The adapter thus typically includes three cylindrical sections of increasing diameter beginning with the stud which has a diameter substantially equal to the internal diameter of tubing to be formed. The opposite end cylindrical section has an axial extent corresponding to the distance the tubing to be formed must extend from the jig or holding bar. The middle cylindrical section has a surface or land adjacent and transverse to the stud for deforming the end of tubing.

A problem encountered with such a construction relates to the opposite end cylindrical section. That end section may not accurately provide a means to control the amount of tubing extending from the bar assembly or jig. Visual alignment is required with the prior art tool set and such alignment is not highly accurate. Thus, there has remained a need to provide an improved means for positioning tubing to be deformed within the jig or holder bar.

SUMMARY OF THE INVENTION

Briefly, the present invention comprises a tool kit or set which includes a jig or bar assembly for holding a length of tubing, a combination gauge and tube forming anvil or adapter and a yoke and cone assembly for driving the adapter and forming the end of a tube or tubing in a double flare configuration. The combination gauge and tube forming anvil includes a projecting stud extending axially from a cylindrical, center body section. Surrounding the base of the stud at the connection to the body section is an annular shaping surface. The opposite side of the center body section defines a datum plane or land. A third coaxial, cylindrical section of lesser diameter extends from the cylindrical center body section thus defining a radially projecting flange spaced from the datum plane to the distal end of the adapter thereby defining a distance correlated to the diameter of a tube to be deformed by the adapter or anvil. The outer end of the anvil opposite the stud includes an axial recess for receiving a driving member associated with the cone and yoke assembly.

In operation or use, the adapter or anvil is placed upon the bar assembly or jig with the outer surface or distal end resting on the bar assembly or jig and the center flange projecting over an opening through the jig wherein a tube is positioned. The flange of the adapter thus provides a limit or stop (datum plane) for the tube extending through the bar assembly or jig. The position of the flange relative to the distal end surface of the adapter is correlated with the size of the tubing to be formed. Upon positioning a tube in the jig or bar assembly, and adjusting its extent or projection from the surface of the assembly, the bar assembly is tightened about the tubing to hold it rigidly in place. Thereafter, the adapter or anvil, and more particularly, the stud is fitted into the tubing and driven against the end of the tubing by the cone and yoke assembly. This step deforms the end of the tubing in a double fold or double flare. The adapter or anvil is then removed and the cone assembly is directly impinged against the end of the tubing to deform and form the seat in the end of the tubing. The construction of the adapter or anvil with the center flange that limits or provides a stop against which the tubing is engaged enables close and exact positioning of the tubing in the jig or bar assembly so that during the flaring operation, bending of the end of the tubing will be effected in a correct manner in each instance.

Thus, it is an object of the invention to provide an improved double flare tool kit or set.

It is a further object of the invention to provide a double flare tool kit which enables positioning of a tube, and more particularly, the end of a tube in an exact and fixed position in a jig or bar assembly for engagement by an adapter or anvil to effect the double flare bend in the end of the tube.

Yet another object of the invention is to provide an economical, easy to use, rugged double flare tool kit wherein in the results associated with use of the kit are highly reproducible and exact.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
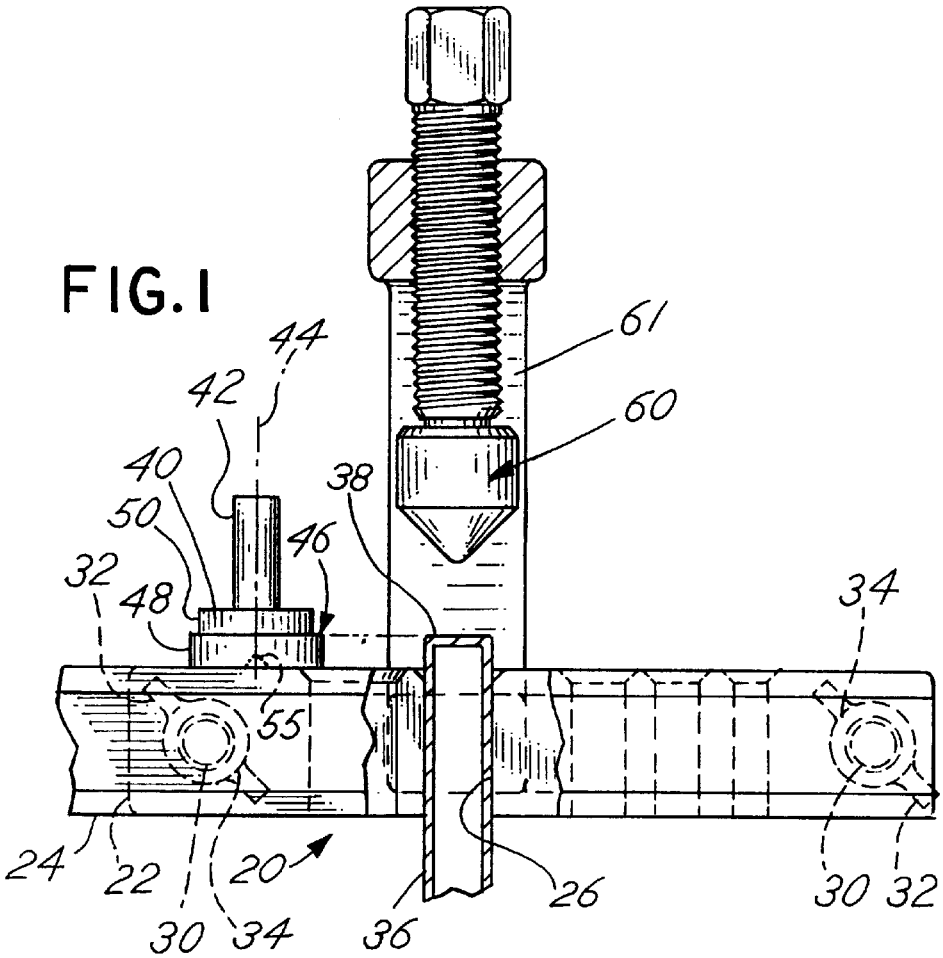
FIG. 1 is a schematic view of the prior art bar assembly or jig in combination with a prior art adapter or anvil, yoke and cone demonstrating and illustrating the use thereof.
Figure 2:
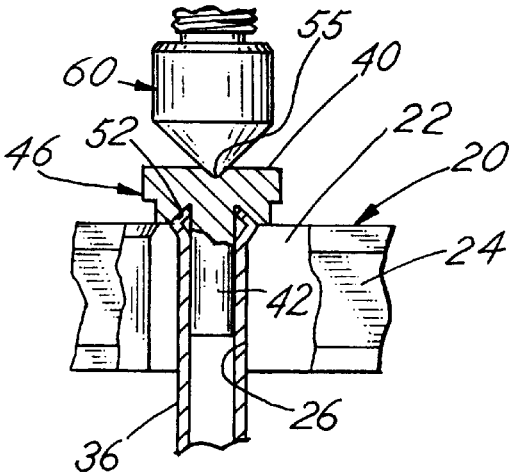
FIG. 2 is a diagrammatic view of the construction of FIG. 1 illustrating the step of utilizing the adapter to deform the end of tubing with a double flare bend.
Figure 3:
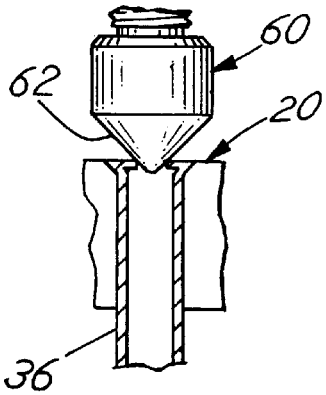
FIG. 3 is a schematic illustration of the prior art tool kit operating further step to complete the double flare bend of tubing.

FIGS. 1, 2 and 3 depict component parts of a prior art kit for forming a double flare in tubing. Referring to FIG. 1, a bar assembly or jig 20 includes a first rectangular cross section bar 22 and a second opposed bar 24 of similar size and shape. The bars 22 and 24 are generally equal in shape and size and each includes a series of opposed semi-cylindrical openings such as openings 26 and 28, pairs of which define a circular passage through the bars 22 and 24 when the bars are facing or opposed to one another. The bars 22 and 24 are held together by a stud or studs 30 each cooperative with a nut 32 and washer 34. First and second studs 30 are thus provided at opposite ends of the bars 22, 24. Tubing 36 may be inserted into a compatably sized passage, such as the passage defined by opposed openings 26 or 28, and the bars 22, 24 may be tightly engaged one against the other to retain tubing 36 tightly in the relevant compatible passage. Thus, the openings 26 and 28 are slightly undersized so as to retain compatible sized tubing 36 tightly therebetween.

To effect a double flare bend in thin steel tubing, aluminum tubing or copper tubing of the type which is used in various automotive and vehicle applications, a mechanic must first insert the tubing 36 through the passage defined by the semi cylindrical openings 26, 28 for the associated tubing size. It is noted that the bars 22, 24 include a frustoconical relief, surface section 35 around each opening 26, 28. Tubing 36 extends a fixed distance 38 above the plane defined by the sides of the bar 22, 24 adjacent the relief section 35.

Next, one positions a prior art adapter 40 adjacent the tubing 36 in the jig 20. Adapter 40 includes a center stud 42, a center line axis 44, a body section 46 having a large diameter lower cylindrical section 48 and a smaller diameter cylindrical outer section 50 with a tube forming surface 52 in the annular region of the section 50 at the base of the stud 42. The adapter or anvil 40 is thus placed on the flat surface of the bar assembly 20 and the top edge of tubing or tube 36 is aligned with the juncture between the cylindrical sections 48 and 50 of adapter 40. This adjustment is a visual adjustment to extend the tubing 36 appropriately above the surface of the bar assembly 20.

Thereafter, the adaptor 40 is positioned over the end of the tubing 36 as depicted in FIG. 2 with the stud 42 fitted into the tubing. A cone assembly comprising a driving cone 60 held by a yoke 61 is then driven against the adapter 40 to cause the tube forming surface 52 to form a double bend in the end of the tubing 36 since the tubing has been rigidly retained in the bar assembly 20. The adapter 40 or anvil 40 includes a coaxial recess or detent 55 in its bottom surface into which the cone 60 may fit in order to drive the adapter 40.

Next, as shown in FIG. 3, the adapter 40 may be removed and the cone 60, and more particularly, the conical surface 62 may be impinged against the end of the double flared tubing 36 to form a seating surface for a fitting. In this manner, the tubing 36 is provided with a double flare end and seal surface.

With the prior art construction, difficulty arises due to visual alignment or misalignment of the end of the tubing 36 relative to the jig 20. Alignment thus may not be accurate. As a result, a double flare bend may not be appropriately formed. With the present invention, a new type of adapter or anvil 66 is provided. Specifically, the adapter or anvil 66 includes a center line axis 68, a projecting stud 70 at one end, a tube forming surface 72 defined by a center body section 74 comprising a cylindrical flange 76, and an opposite end cylindrical section 78 of lesser diameter than center section 74. The end cylindrical section 78 terminates with a distal end surface 80 transverse to axis 68. All the sections 70, 74, 78 are coaxial and cylindrical. A coaxial recess 82 is formed in the distal end surface 80.

The driving cone 60 and yoke 61 are the same as previously described. Thus, the yoke 61 includes spaced arms 84 and 86 with inwardly extending guide members 88 and 90 which fit into appropriate matching slots or channels 92 and 94 of the bar or jig 20. A threaded pusher screw 96 is threadably inserted into the yoke 61 to drive the cone 60. The driving cone 60 includes a pointed end 63 adapted to engage the recess 82 formed in the datum plane 80 of the adapter 66.

Figure 4:
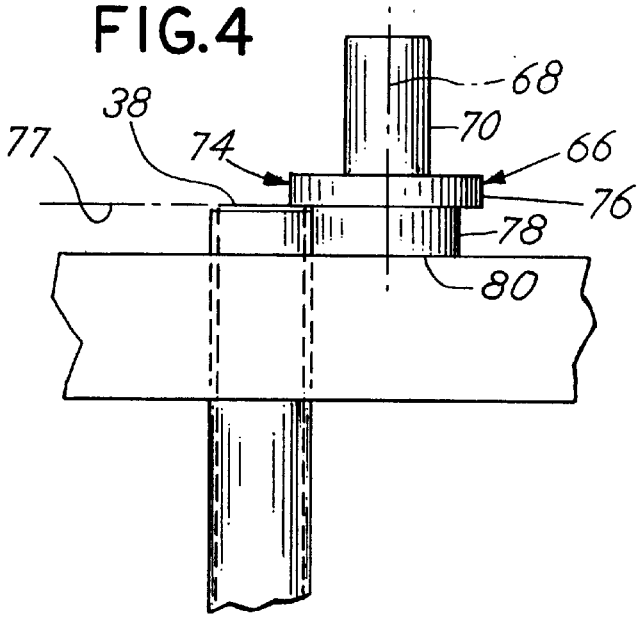
FIG. 4 is a diagrammatic view of the improved tool of the invention including the adapter or anvil.
Figure 5:
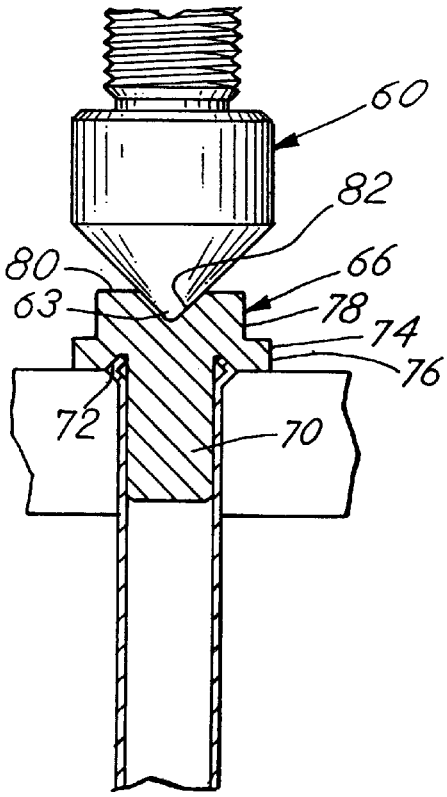
FIG. 5 is a diagrammatic view of the tool kit of FIG. 4 illustrating a further step in the use thereof.
Figure 6:
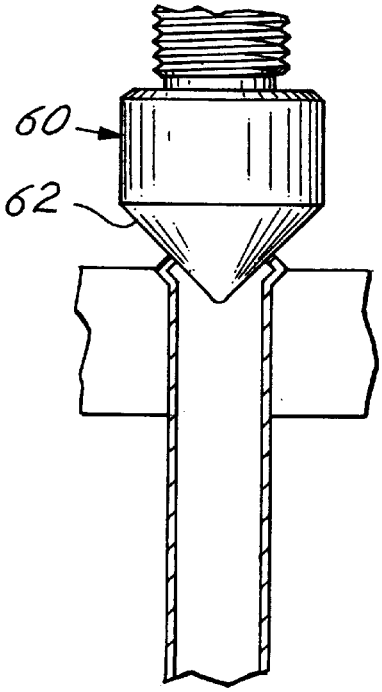
FIG. 6 is a further diagrammatic view illustrating the next sequential step in the use of the tool kit of FIG. 4.
Figure 7:
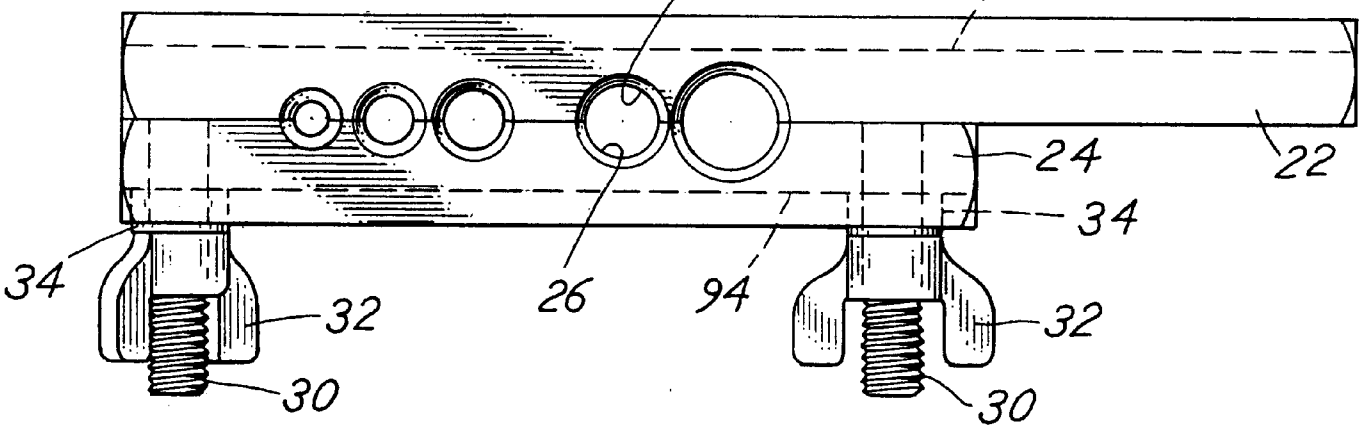
FIG. 7 is a top plan view of the bar assembly used in the embodiment of FIG. 4.
Figure 10:
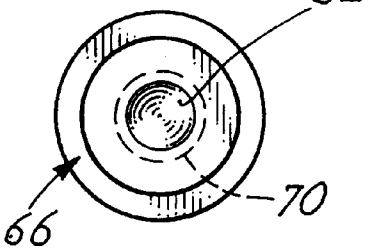
FIG. 10 is a top end view of the adapter of FIG. 8.
Figure 9:
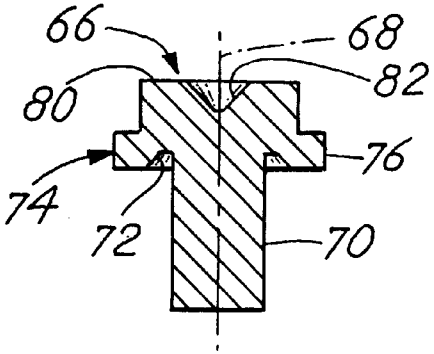
FIG. 9 is a side cross sectional view of the anvil or adapter of FIG. 8.
Figure 8:
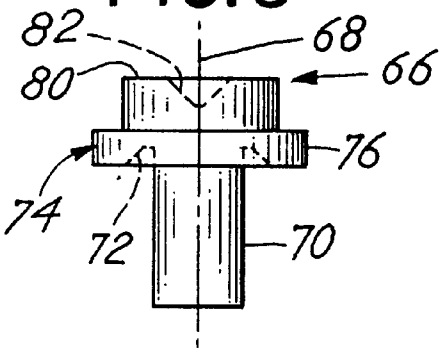
FIG. 8 is a side view of a typical adapter incorporated in the kit of FIGS. 4, 5 and 6.
Figure 11:
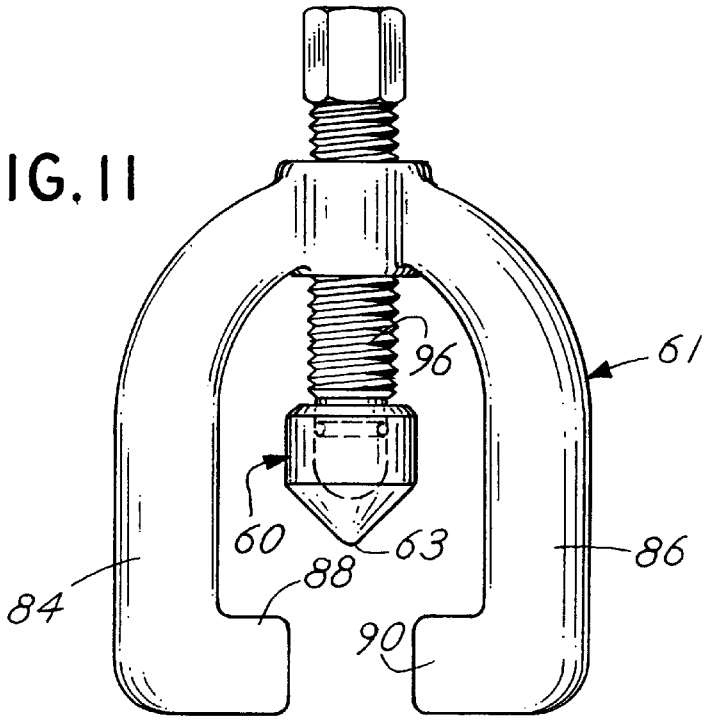
FIG. 11 is a plan view of the yoke and cone assembly used in the kit of the invention.
Figure 12:
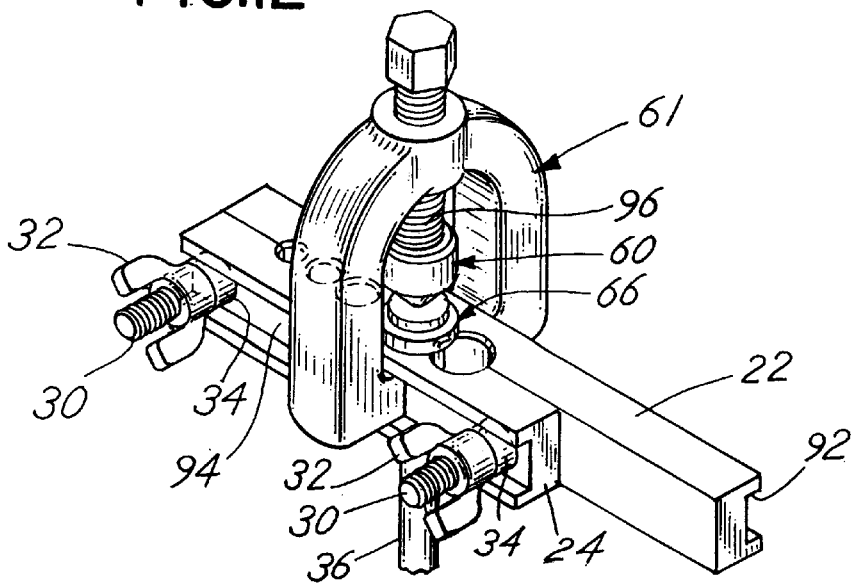
FIG. 12 is an isometric view illustrating the manner of use of the kit of the invention.

Thus in use of the kit comprised of the bar assembly, adapter 66 and yoke 61 as well as cone 60, tubing 36 is first placed in the bar assembly 20 as shown in FIG. 4. The flange 78 then defines a stop against which the top end of the tubing 36, namely end 38, will extend in order to project from the bar assembly 20. This is effected by positioning of the distal end surface 80 on the top of the bar assembly 20 as the tubing 36 projects through the appropriate opening in the bar assembly 20 and impinging the end 38 of the tubing 36 against the flange 76, i.e., the datum plane 77 thereof. The nuts 32 are then tightened to rigidly hold the tubing 36 in place. The yoke 61 is guided into the channels 92 and 94. Thereafter, the adapter 66 is positioned in the tubing 36 as shown in FIG. 5, and the cone 60 positioned over the adapter 66 to engage the recess 82. The screw 96 of yoke 61 is tightened to cause the cone 60 to drive the adapter 66 to deform the end of the tubing 36. The frustoconical surface 35 defines an outward flare as shown in FIG. 5 and the forming surface 72 of adapter 66 defines the inward flare, again, as shown in FIG. 5. Thereafter, the adapter 66 is removed as shown in FIG. 6 and the cone 60, and more particularly, the conical surface 62 thereof is impinged against the outer end 38 of the tubing to provide a seat having a face which matches the inclination of the cone surface 62.

With the adapter 66 of the present invention, therefore, the position or extension of the tubing 36, namely, end 38, is precisely and uniformly effected in every instance. Thus, the double flare is precisely formed for engagement with a fitting or other connector associated with a vehicle system such as a brake fluid system or the like.

It is possible to vary the component parts of the invention. For example, different types of bar assemblies and/or even cone assemblies may be utilized. The invention is therefore to be limited only by the following claims and equivalents thereof.

What is claimed is:

1. A tool kit for forming a double flare in the end of deformable tubing comprising, in combination;

(a) a jig with a plurality of circular vice grip openings to retain tubing with an exposed end of the tubing projected a fixed extent from a basal plane of the jig;

(b) a set of combination gauge and tube forming anvils, each of said anvils including a cylindrical center body section having a centerline axis, an axially projecting stud from one end of the body section with a reduced diameter, an annular tube forming surface in the center body section surrounding coaxial with the stud, a reduced diameter opposite end section defining a distal end surface and projecting coaxially from the center body section at the end opposite the stud, said center body section defining a laterally projecting land spaced at a fixed axial distance from the distal end surface correlated with the diameter of tubing to be formed by the tube forming surface, said stud elongated to fit within said tubing in the vice grip opening, each one of said anvils being associated with a single vice grip opening for placement of the distal end surface on the basal plane to locate tubing projecting axially from the vice grip opening and for placement of the stud in a tubing opening to form the end of said tubing; and (c) a cone assembly including a cone forming surface for engaging the open end of a tube and deforming the open end to provide a seat surface on the end of the tubing, and also to drive the tube forming surface of the anvil against tubing fastened in the jig projecting a fixed axial distance from the base plane equal to the fixed axial distance of the land from the distal end surface.

* * * * *